US011353188B2

(12) United States Patent
Yamamura

(10) Patent No.: US 11,353,188 B2
(45) Date of Patent: Jun. 7, 2022

(54) OPTICAL UNIT

(71) Applicant: KOITO MANUFACTURING CO., LTD., Tokyo (JP)

(72) Inventor: Satoshi Yamamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/689,153

(22) Filed: Nov. 20, 2019

(65) Prior Publication Data

US 2020/0080702 A1 Mar. 12, 2020

Related U.S. Application Data

(63) Continuation of application No. PCT/JP2018/017711, filed on May 8, 2018.

(30) Foreign Application Priority Data

May 26, 2017 (JP) ..... JP2017-104920

(51) Int. Cl.

| | |
|---|---|
| ***F21S 41/33*** | (2018.01) |
| ***F21S 41/675*** | (2018.01) |
| ***F21S 41/145*** | (2018.01) |
| ***F21V 7/04*** | (2006.01) |
| ***F21V 14/04*** | (2006.01) |

(52) U.S. Cl.

CPC ..... *F21S 41/33* (2018.01); *F21S 41/145* (2018.01); *F21S 41/675* (2018.01); *F21V 7/04* (2013.01); *F21V 14/04* (2013.01)

(58) Field of Classification Search

CPC ..... F21S 41/30; F21S 41/67–675; F21S 41/33–338; F21S 41/334–336; F21V 14/04

See application file for complete search history.

(56) References Cited

U.S. PATENT DOCUMENTS

| | | | | |
|---|---|---|---|---|
| 2013/0038736 | A1 | 2/2013 | Yamamura | |
| 2014/0313755 | A1* | 10/2014 | Tanaka | F21S 41/153 362/514 |
| 2015/0219302 | A1* | 8/2015 | Yagi | F21S 41/365 362/512 |
| 2016/0341388 | A1 | 11/2016 | Tanaka et al. | |

(Continued)

FOREIGN PATENT DOCUMENTS

| | | | |
|---|---|---|---|
| CN | 103492792 | A | 1/2014 |
| CN | 104110628 | A | 10/2014 |

(Continued)

OTHER PUBLICATIONS

International Search Report (Form PCT/ISA/210) dated Jul. 10, 2018, in corresponding international Application No. PCT/JP2018/017711. (4 pages).

(Continued)

*Primary Examiner* — Mariceli Santiago

(74) *Attorney, Agent, or Firm* — Buchanan Ingersoll & Rooney PC

(57) ABSTRACT

An optical unit includes a light source and a rotary reflector that rotates about an axis of rotation while reflecting light emitted from the light source. The rotary reflector is disposed such that the axis of rotation of the rotary reflector intersects a horizontal plane.

10 Claims, 9 Drawing Sheets

(56) References Cited

U.S. PATENT DOCUMENTS

| | | | |
|---|---|---|---|
| 2017/0115479 | A1 | 4/2017 | Yatsuda et al. |
| 2018/0051857 | A1 | 2/2018 | Yamada et al. |

FOREIGN PATENT DOCUMENTS

| | | | |
|---|---|---|---|
| CN | 102844616 | B | 6/2015 |
| CN | 105465715 | A | 4/2016 |
| CN | 105992908 | A | 10/2016 |
| DE | 102014211678 | A1 | 12/2014 |
| EP | 2559935 | A1 | 2/2013 |
| EP | 2700538 | A1 | 2/2014 |
| EP | 3048362 | A1 | 7/2016 |
| JP | 2016-075722 | A | 5/2016 |
| JP | 2017-037806 | A | 2/2017 |
| WO | 2011/129105 | A1 | 10/2011 |
| WO | 2015/122304 | A1 | 8/2015 |
| WO | 2016/204139 | A1 | 12/2016 |

OTHER PUBLICATIONS

International Preliminary Report on Patentability (Form PCT/IB/373) and the Written Opinion of the International Searching Authority (Form PCT/ISA/237) dated Nov. 26, 2019, in corresponding international Application No. PCT/JP2018/017711. (15 pages).

Extended European Search Report dated Jan. 19, 2021, issued by the European Patent Office in corresponding European Application No. 18805800.2. (6 pages).

The First Office Action, issued by the National Intellectual Property Administration of the People's Republic of China, in corresponding Chinese Patent Application No. 201880031684.8 dated Mar. 3, 2021 (16 pages including partial English translation).

Second Office Action dated Sep. 27, 2021, issued in the corresponding Chinese Patent Application No. 201880031684.8, 16 pages including 10 pages of English Translation.

Office Action dated Feb. 14, 2022, in corresponding Chinese Patent Application No. 201880031684.8 and English translation of the Office Action (14 pages).

* cited by examiner

60

OPTICAL UNIT

CROSS-REFERENCE TO RELATED APPLICATIONS

This application is based upon and claims the benefit of priority from the prior Japanese Patent Application No. 2017-104920, filed on May 26, 2017 and International Patent Application No. PCT/JP2018/017711, filed on May 8, 2018, the entire content of each of which is incorporated herein by reference.

BACKGROUND OF THE INVENTION

1. Field of the Invention

The present invention relates to optical units.

2. Description of the Related Art

In an optical unit devised to date, light emitted sideways from a light source is reflected forward by a rotary reflector to form a desired light-distribution pattern (see patent document 1).

[patent document 1] WO2011/129105

The aforementioned optical unit tends to have a large width as a whole since the light source is disposed toward a side of the rotary reflector. Therefore, it may be difficult to employ such an optical unit in a vehicle headlamp due to a design constraint.

SUMMARY OF THE INVENTION

The present invention has been made in view of the above and is directed to providing, for example, an optical unit with a novel configuration arrangement.

To solve the above-described problem, an optical unit according to an aspect of the present invention is an optical unit for use in a vehicle lamp, and the optical unit includes a light source and a rotary reflector that rotates about an axis of rotation while reflecting light emitted from the light source. The rotary reflector is disposed such that the axis of rotation of the rotary reflector intersects a horizontal plane.

BRIEF DESCRIPTION OF THE DRAWINGS

Embodiments will now be described, byway of example only, with reference to the accompanying drawings that are meant to be exemplary, not limiting, and wherein like elements are numbered alike in several figures, in which.

DETAILED DESCRIPTION OF THE INVENTION

Figure 1:
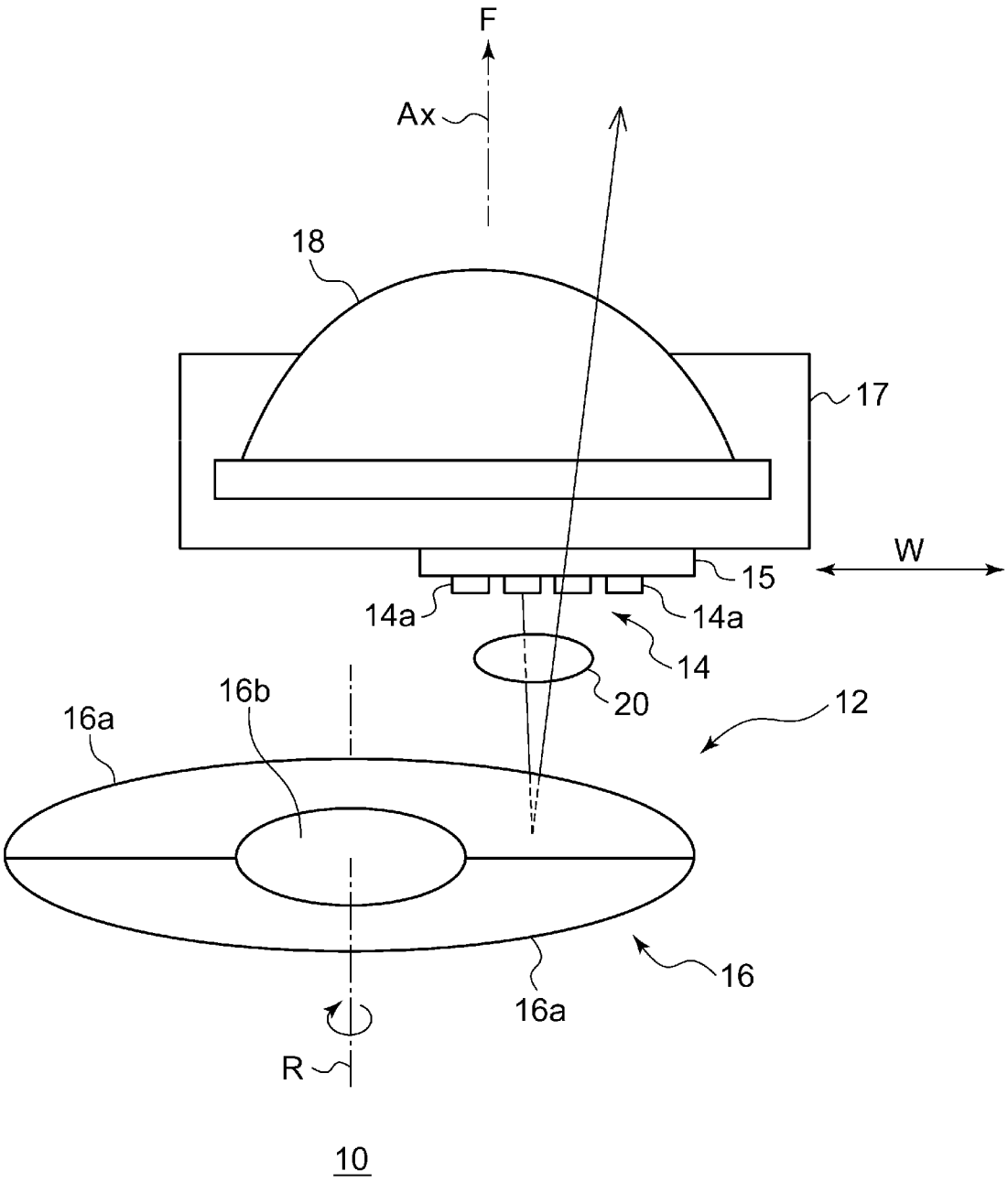
FIG. 1 is a top view schematically illustrating a general configuration of a vehicle headlamp according to a first embodiment.

Hereinafter, the present invention will be described on the basis of embodiments with reference to the drawings. Identical or equivalent constituent elements, members, and processes illustrated in the drawings are given identical reference characters, and duplicate descriptions thereof will be omitted as appropriate. The embodiments are illustrative in nature and are not intended to limit the invention. Not all the features and combinations thereof described in the embodiments are necessarily essential to the invention.

To solve the above-described problem, an optical unit according to an aspect of the present invention is an optical unit for use in a vehicle lamp, and the optical unit includes a light source and a rotary reflector that rotates about an axis of rotation while reflecting light emitted from the light source. The rotary reflector is disposed such that the axis of rotation of the rotary reflector intersects a horizontal plane.

This aspect allows the light source to be disposed above or below the axis of rotation of the rotary reflector.

The optical unit may further include a projection lens that projects the light emitted from the light source and reflected by the rotary reflector in a light-irradiation direction of the optical unit. The light source may be disposed between the rotary reflector and the projection lens in a front-back direction of a vehicle and below the axis of rotation of the rotary reflector. This configuration can limit the length of the optical unit in the front-back direction of the vehicle.

The light source may include a first light source including one or more first light-emitting elements and a second light source including one or more second light-emitting elements. The rotary reflector may reflect light emitted from the first light source off one region in a right or left side of the rotary reflector and reflect light emitted from the second light source off another region in the right or left side of the rotary reflector. This configuration allows the single rotary reflector to reflect the light emitted from the two light sources.

The optical unit may further include a substrate on which the first light source and the second light source are mounted. This configuration can reduce the number of components and reduce the manufacturing processes.

The projection lens may include a first projecting portion where the light emitted from the first light source and reflected by the rotary reflector enters and a second projecting portion where the light emitted from the second light source and reflected by the rotary reflector enters. This configuration can form a plurality of light-distribution patterns.

A light-blocking portion may be provided on an incident surface of the projection lens, and the light-blocking portion may be disposed to prevent the light emitted from the first light source and reflected by the rotary reflector from entering the second projecting portion and to prevent the light emitted from the second light source and reflected by the rotary reflector from entering the first projecting portion. This configuration can suppress, for example, a situation in which, although the second light source is off, the light emitted from the first light source passes through the second projecting portion as stray light to produce glare. Alternatively, the above configuration can suppress a situation in which, although the first light source is off, the light emitted from the second light source passes through the first projecting portion as stray light to produce glare.

The first projecting portion may have a posterior focal length L1 greater than a posterior focal length L2 of the second projecting portion. The axis of rotation of the rotary reflector may be inclined toward the first projecting portion relative to the front-back direction of the vehicle. This configuration allows the light emitted from the first projecting portion to be condensed more easily than the light emitted from the second projecting portion, for example. To rephrase, the light emitted from the second projecting portion is diffused more easily than the light emitted from the first projecting portion.

The rotary reflector may include a rotary portion and a plurality of blades that are provided around the rotary portion and that function as a reflective surface. The reflective surface of the rotary reflector may be provided such that light from the light source reflected by the rotating reflective surface forms a light-distribution pattern.

Any optional combination of the above constituent elements or an embodiment obtained by converting what is expressed by the present invention among a method, an apparatus, a system, and so on is also effective as an embodiment of the present invention.

An optical unit according to the embodiments can find its use in a variety of lamps. In the cases described hereinafter, the optical unit according to the embodiments is applied to, among lamps, a vehicle headlamp.

First Embodiment

Figure 2:
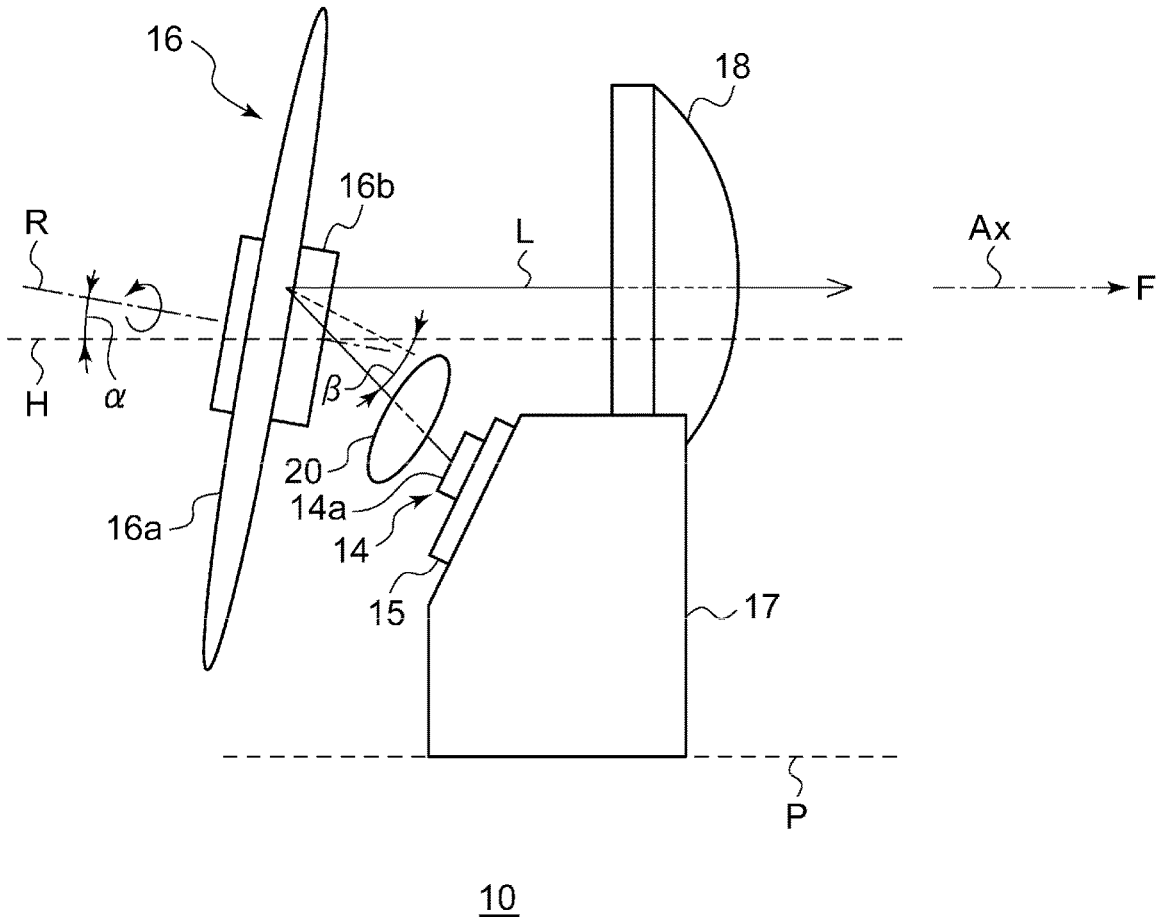
FIG. 2 is a side view schematically illustrating a general configuration of the vehicle headlamp according to the first embodiment.

FIG. 1 is a top view schematically illustrating a general configuration of a vehicle headlamp according to a first embodiment. FIG. 2 is a side view schematically illustrating a general configuration of the vehicle headlamp according to the first embodiment. In the following drawings, some components, such as a lamp body, a cover, and an extension, constituting the vehicle headlamp are omitted.

A vehicle headlamp 10 includes an optical unit 12. The optical unit 12 includes a light source 14 and a rotary reflector 16 that rotates about an axis of rotation R while reflecting light emitted from the light source 14. The rotary reflector 16 is disposed such that the axis of rotation R of the rotary reflector intersects a horizontal plane H.

Herein, the horizontal plane H can be defined not only physically as a plane intersecting the earth's gravitational force at a right angle but also, for example, as a plane that includes an optical axis and/or a center axis of a projection lens described later (a straight line passing through the center of the projection lens) and that is parallel to a reference surface P on which the vehicle headlamp 10 is placed. Alternatively, the horizontal plane H may be a plane that includes the optical axes of the vehicle's right and left headlamps. That the axis of rotation R intersects the horizontal plane H includes a case in which a line extending from the axis of rotation R intersects the horizontal plane H.

The light source 14 includes four light-emitting elements 14*a* arrayed in a widthwise direction W of the vehicle. The light-emitting elements are each a semiconductor light-emitting element, such as an LED, an EL element, or an LD element. The light-emitting elements 14*a* are mounted on a single element-mounting substrate 15. The element-mounting substrate 15 is fixed to a surface of a heat sink 17.

Figure 3:
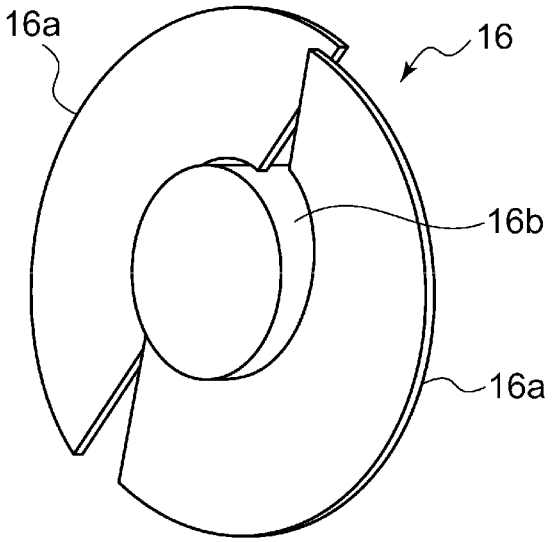
FIG. 3 is a side view schematically illustrating a configuration of a rotary reflector according to the first embodiment.
Figure 4:
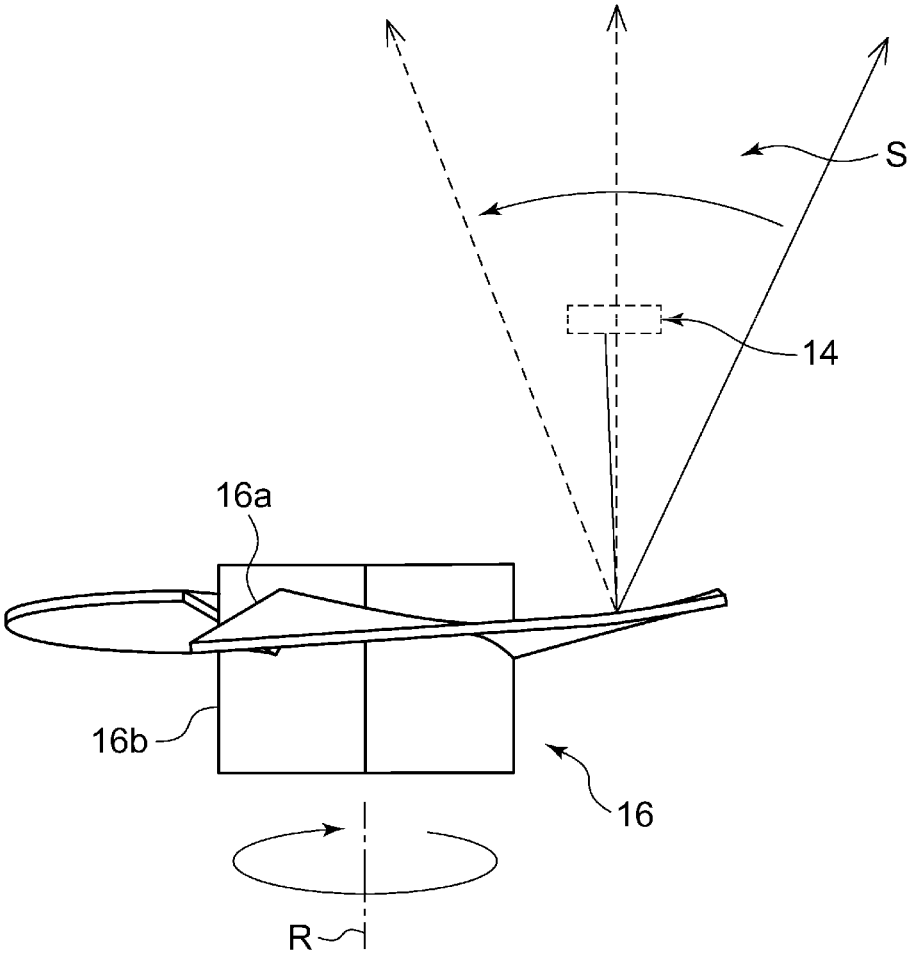
FIG. 4 is a top view schematically illustrating a configuration of the rotary reflector according to the first embodiment.

FIG. 3 is a side view schematically illustrating a configuration of the rotary reflector according to the first embodiment. FIG. 4 is a top view schematically illustrating a configuration of the rotary reflector according to the first embodiment.

The rotary reflector 16 rotates with a driving source, such as a motor, unidirectionally about the axis of rotation R. The rotary reflector 16 includes blades 16*a*, serving as a reflective surface, provided to form a desired light-distribution pattern by scanning light from each light source reflected by the rotating rotary reflector 16. In other words, the rotating operation of the rotary reflector 16 causes visible light from a light emitter to be emitted as an irradiation beam, and a desired light-distribution pattern is formed as the rotary reflector 16 scans the irradiation beam.

The rotary reflector 16 includes the two blades 16*a*, which function as a reflective surface and are identical in shape, and the two blades 16*a* are provided around a cylindrical rotary portion 16*b*. The axis of rotation R of the rotary reflector 16 is at an angle relative to the horizontal plane H. To rephrase, the axis of rotation R intersects a scanning plane S of light (irradiation beam) from each light source that scans in the right-left direction through rotation. This configuration reduces the thickness of the optical unit. Herein, the scanning plane can be regarded as a fan-shaped plane formed by continuously connecting the trajectories of light from each light source, or the scanning light, for example. This scanning plane S may be regarded as the horizontal plane H described above.

Each blade 16*a* of the rotary reflector 16 has a twisted shape in which the angle formed by an optical axis Ax and the reflective surface changes along the circumferential direction about the axis of rotation R. This configuration enables the scan with the light from the light source 14, as illustrated in FIG. 4.

As illustrated in FIG. 2, in the optical unit 12 according to the present embodiment, the light source 14 can be disposed below the axis of rotation R of the rotary reflector 16. Alternatively, as the optical unit 12 is inverted vertically, the light source 14 can be disposed above the axis of rotation R of the rotary reflector 16.

The optical unit 12 further includes a projection lens 18 that projects the light emitted from the light source 14 and reflected by the rotary reflector 16 in a light-irradiation direction (forward F) of the optical unit 12. The light source 14 is disposed between the rotary reflector 16 and the projection lens 18 in the front-back direction of the vehicle (the direction along the optical axis Ax) and below an optical path L of the light reflected by the rotary reflector 16 (or below the axis of rotation of the rotary reflector 16). This configuration can limit the length of the optical unit 12 in the front-back direction of the vehicle.

The optical unit 12 according to the present embodiment includes a condenser lens 20 serving as a primary optical system (optical member) that redirects the optical path of the light emitted from the light source 14 toward the blades 16*a* of the rotary reflector 16.

Figure 5A:
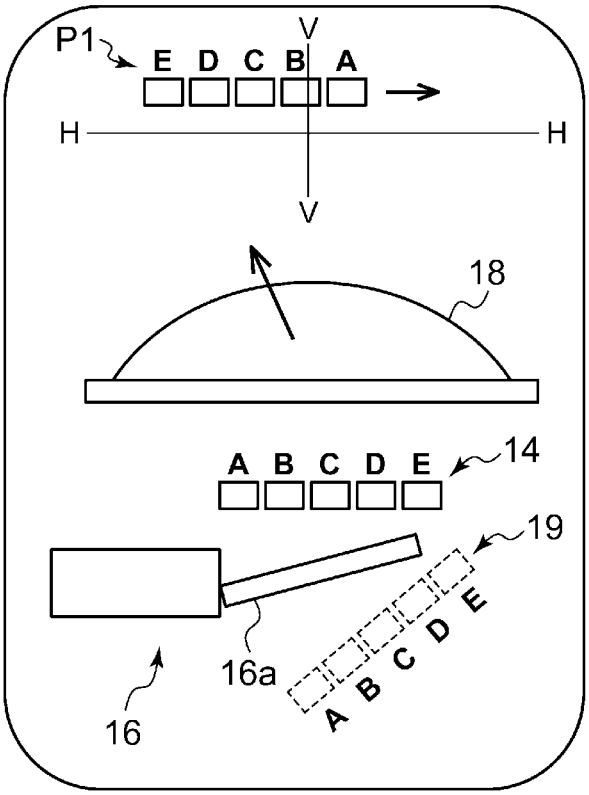
FIG. 5(*a*) is a schematic diagram for describing a light source image obtained when the rotary reflector's blade is being rotated 20° relative to a reference position, and FIG. 5(*b*) is a schematic diagram for describing a light source image obtained when the rotary reflector's blade is being rotated 160° relative to the reference position.
Figure 5B:
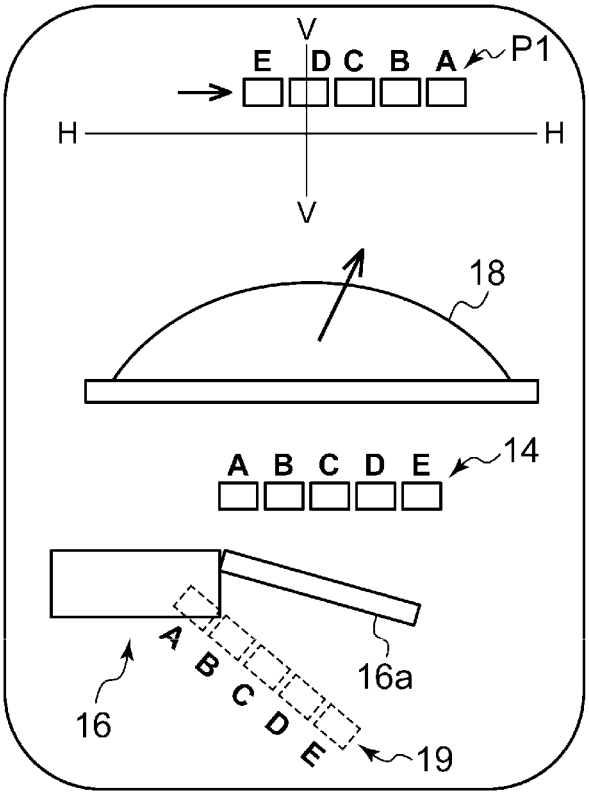

Now, movement of a light source image in association with rotation of the rotary reflector 16 will be described. FIG. 5 (*a*) is a schematic diagram for describing a light source image obtained when a blade 16*a* of the rotary reflector 16 is being rotated 20° relative to a reference position. FIG. 5(*b*) is a schematic diagram for describing a light source image obtained when a blade 16*a* of the rotary reflector 16 is being rotated 160° relative to the reference position.

As illustrated in FIG. 5 (*a*), a secondary light source (light source virtual image) 19 of the light source 14 is on the opposite side from the light source 14 across the blade 16*a*. Then, as light from the secondary light source 19 is projected in an inverted manner, a pattern P1 composed of a light source image is formed on the front side. Thereafter, as illustrated in FIG. 5 (*b*), the blade 16*a* of the rotary reflector 16 rotates to the 160-degree position relative to the reference position. The secondary light source (light source virtual image) 19 of the light source 14 obtained at this position is illustrated in FIG. 5 (*b*). Then, as light from the secondary light source 19 is projected in an inverted manner, a pattern P1 composed of a light source image is formed on the front side.

As illustrated in FIGS. 5(*a*) and 5 (*b*), the rotary reflector 16 includes the blades 16*a* that function as a reflective surface. The reflective surface of the rotary reflector 16 is provided such that light from the light source reflected by the rotating rotary reflector 16 forms a light-distribution pattern.

Second Embodiment

Figure 6:
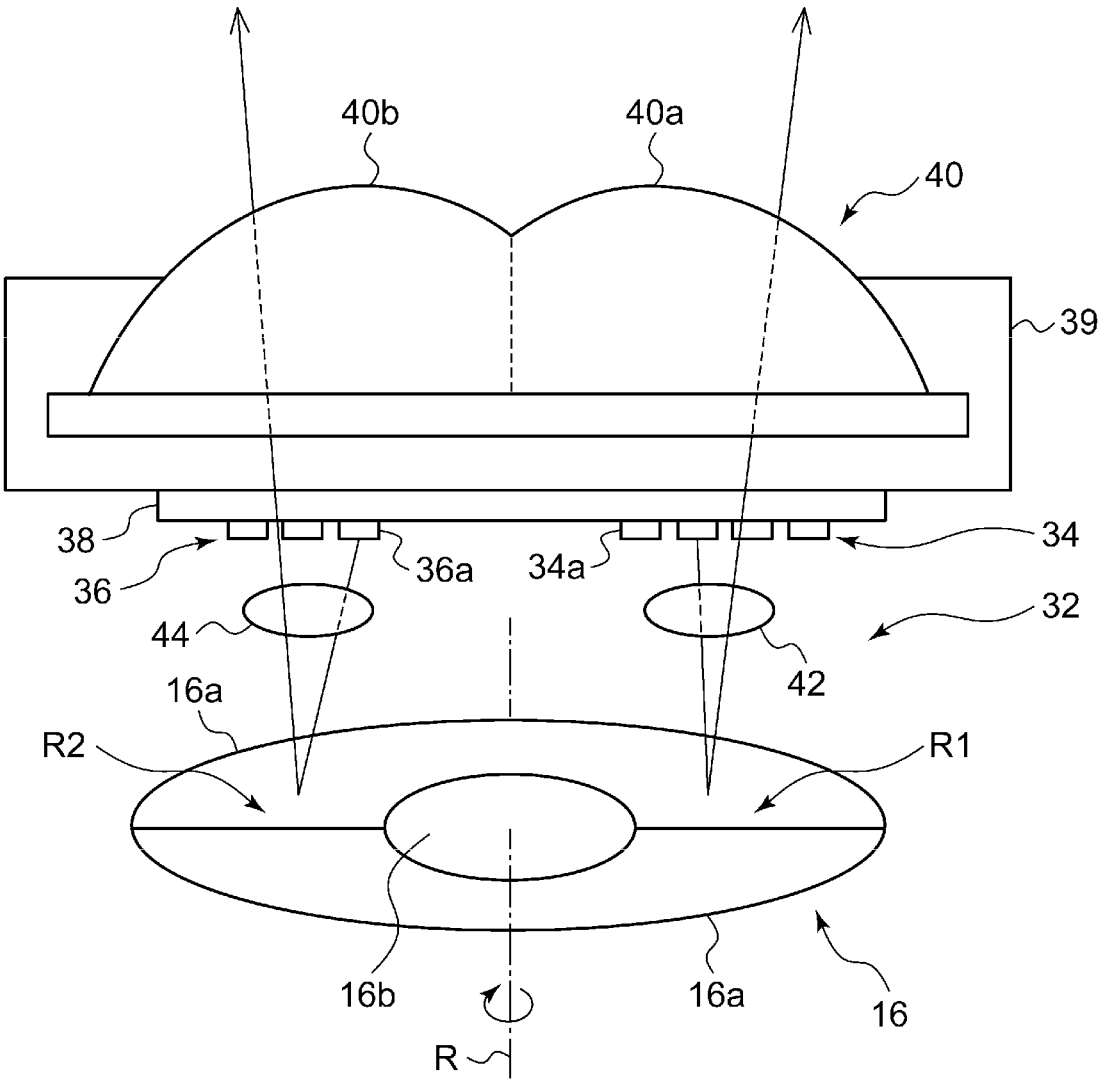
FIG. 6 is a top view illustrating a general configuration of a vehicle headlamp according to a second embodiment.

FIG. 6 is a top view illustrating a general configuration of a vehicle headlamp according to a second embodiment. A side view illustrating a general configuration of the vehicle headlamp according to the second embodiment is substantially the same as the side view illustrated in FIG. 2, and thus the drawing is omitted.

A vehicle headlamp 30 includes an optical unit 32. The optical unit 32 includes a first light source 34 including four light-emitting elements 34*a* and a second light source 36 including three light-emitting elements 36*a*. The rotary reflector 16 reflects light emitted from the first light source 34 off a region R1 in the right side of the rotary reflector and reflects light emitted from the second light source 36 off a region R2 in the left side of the rotary reflector 16. This configuration allows the single rotary reflector 16 to reflect the light emitted from the two light sources.

The optical unit 32 further includes a common element-mounting substrate 38 on which the first light source 34 and the second light source 36 are mounted. This configuration can reduce the number of substrates and reduce the manufacturing processes. The element-mounting substrate 38 is fixed to a surface of a heat sink 39.

The optical unit 32 further includes a projection lens 40. The projection lens 40 includes a first projecting portion 40*a* where light emitted from the first light source 34 and reflected by the rotary reflector 16 enters and a second projecting portion 40*b* where light emitted from the second light source 36 and reflected by the rotary reflector 16 enters. The projection lens 40 is a unitary component in which the first projecting portion 40*a* and the second projecting portion 40*b* are integrated. This configuration can reduce the number of lenses. This configuration also allows a single light-distribution pattern where a plurality of light-distribution patterns are combined to be formed with a single optical unit.

The optical unit 32 according to the present embodiment includes a condenser lens 42, serving as a primary optical system (optical member), that redirects the optical path of the light emitted from the first light source 34 toward the region R1 in the right side of the rotary reflector 16 and a condenser lens 44, serving as a primary optical system (optical member), that redirects the optical path of the light emitted from the second light source 36 toward the region R2 in the left side of the rotary reflector 16.

Third Embodiment

Figure 7:
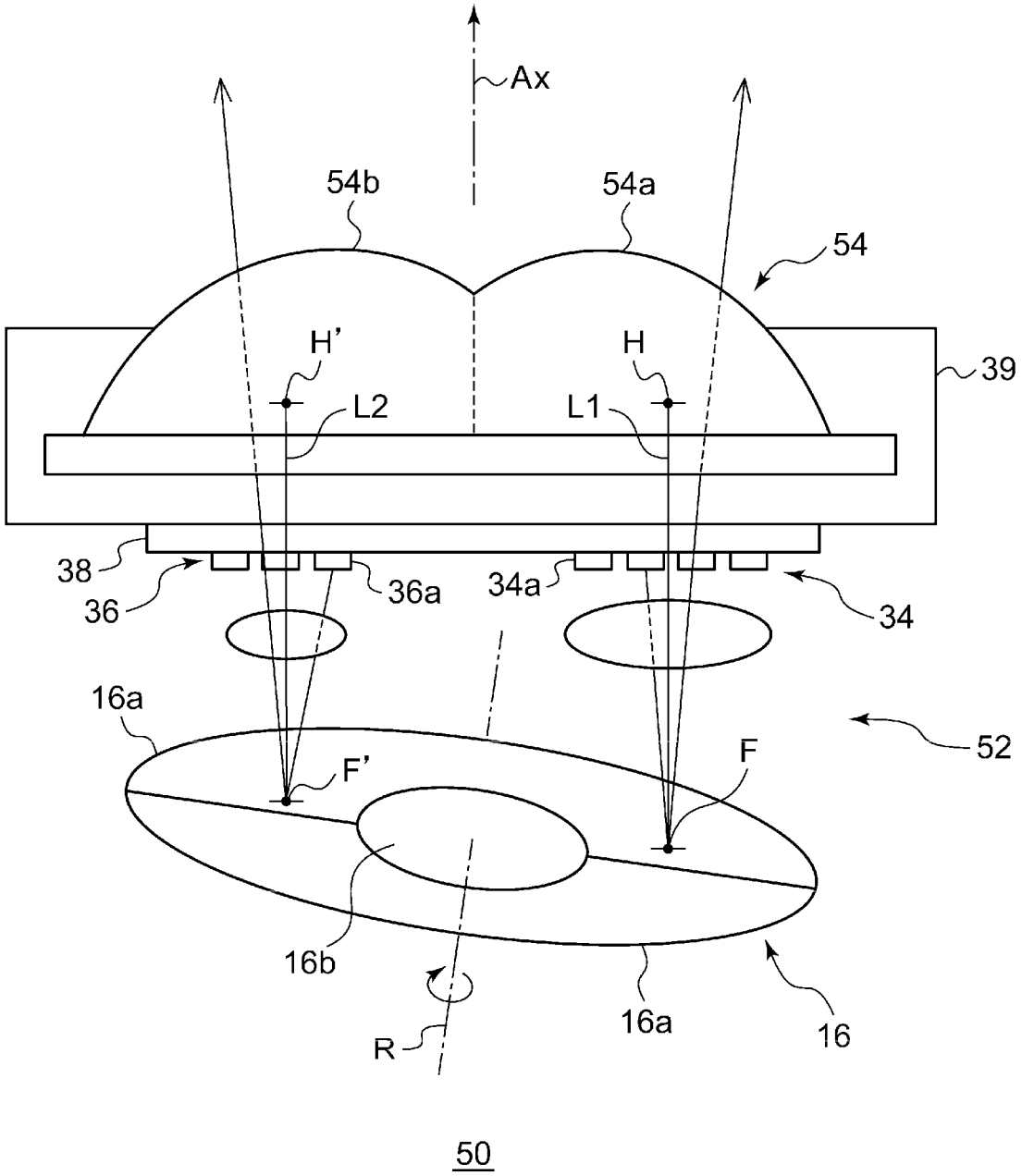
FIG. 7 is a top view schematically illustrating a general configuration of a vehicle headlamp according to a third embodiment.
Figure 8:
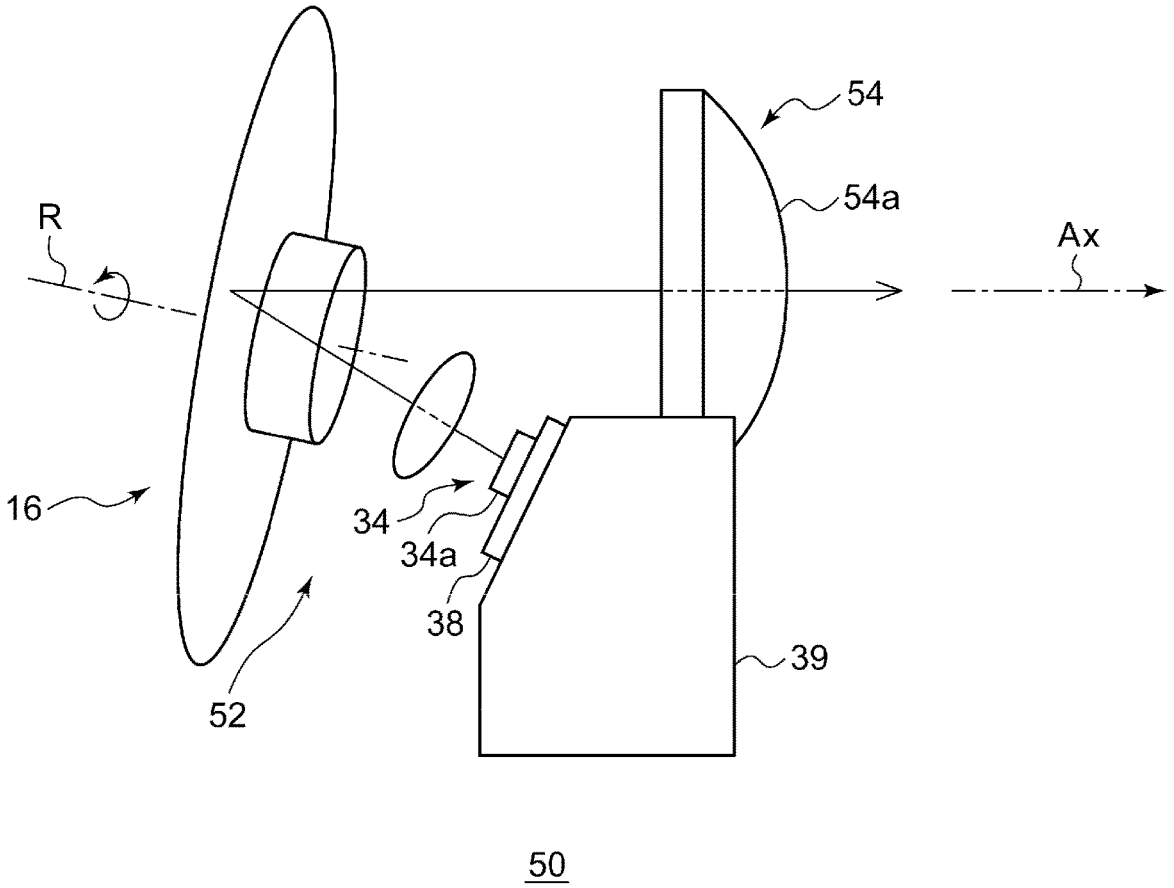
FIG. 8 is a side view schematically illustrating a general configuration of the vehicle headlamp according to the third embodiment.

FIG. 7 is a top view schematically illustrating a general configuration of a vehicle headlamp according to a third embodiment. FIG. 8 is a side view schematically illustrating a general configuration of the vehicle headlamp according to the third embodiment. Configurations similar to those in the second embodiment are given identical reference characters, and descriptions thereof will be omitted as appropriate.

A vehicle headlamp 50 according to the third embodiment includes an optical unit 52. The optical unit 52 includes a projection lens 54. A first projecting portion 54*a* of the projection lens 54 has a posterior focal length L1 (the distance between a principal point H and a posterior focal point F) greater than a posterior focal length L2 (the distance between a principal point H' and a posterior focal point F') of a second projecting portion 54*b*. The axis of rotation R of the rotary reflector 16 is inclined toward the first projecting portion 54*a* relative to the front-back direction of the vehicle (the direction along the optical axis Ax).

This configuration allows light emitted from the first projecting portion 54*a* to be condensed more easily than light emitted from the second projecting portion 54*b*, for example. To rephrase, the light emitted from the second projecting portion 54*b* is diffused more easily than the light emitted from the first projecting portion 54*a*. To further rephrase, the light that has passed through the first projecting portion 54*a* has a relatively smaller scanning region, which in turn leads to a higher luminous intensity. Meanwhile, the light that has passed through the second projecting portion 54*b* has a relatively greater scanning region, which in turn leads to a lower luminous intensity.

In other words, a light-distribution pattern formed by the light that has passed through the first projecting portion 54*a* has a small irradiation range but a high luminous intensity and is thus suitable for a high-beam light-distribution pattern, for example. A light-distribution pattern formed by the light that has passed through the second projecting portion 54*b* has a low luminous intensity but a great irradiation range and is thus suitable for a low-beam light-distribution pattern, for example.

Fourth Embodiment

Figure 9:
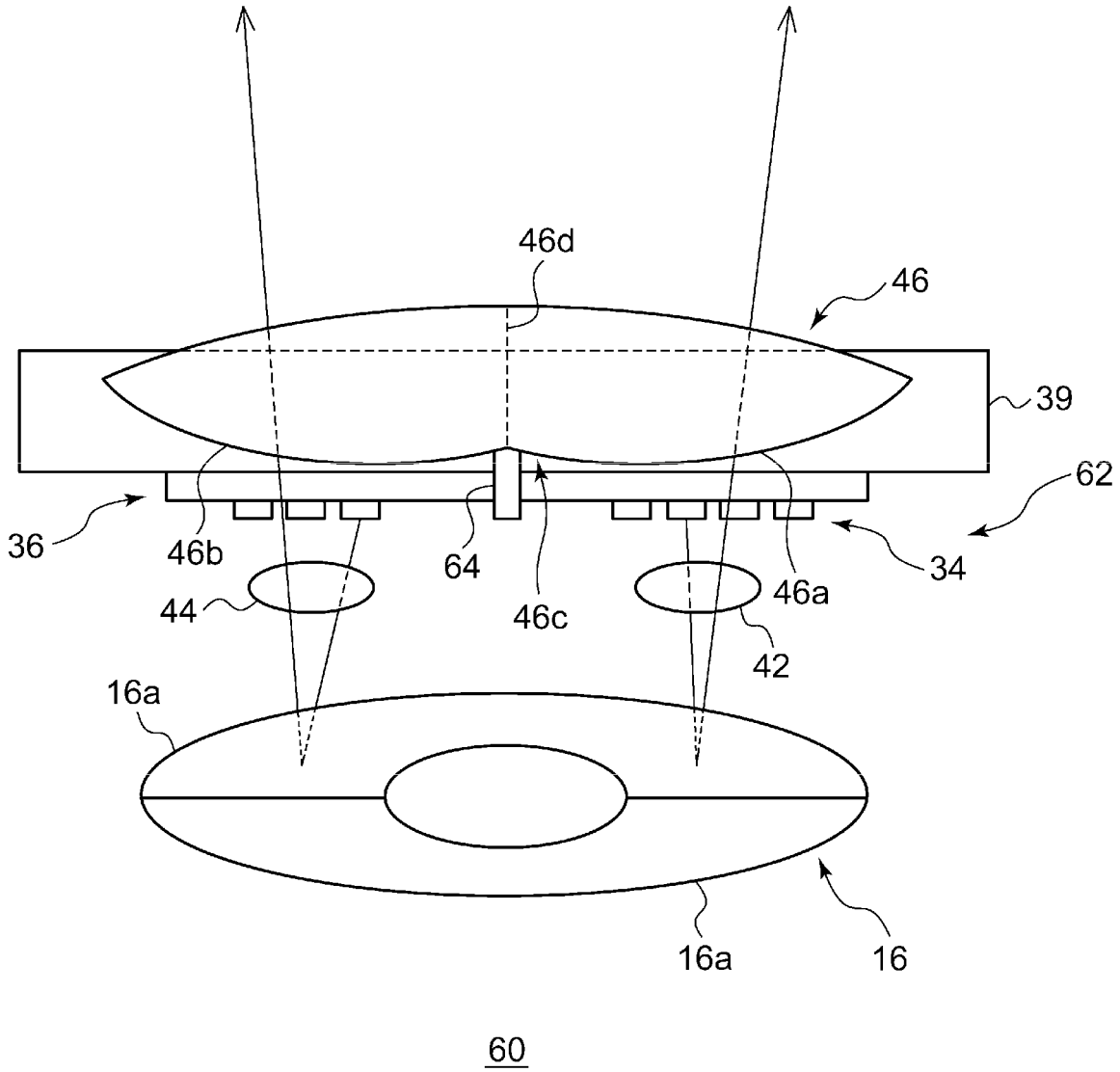
FIG. 9 is a top view schematically illustrating a general configuration of a vehicle headlamp according to a fourth embodiment.
Figure 10:
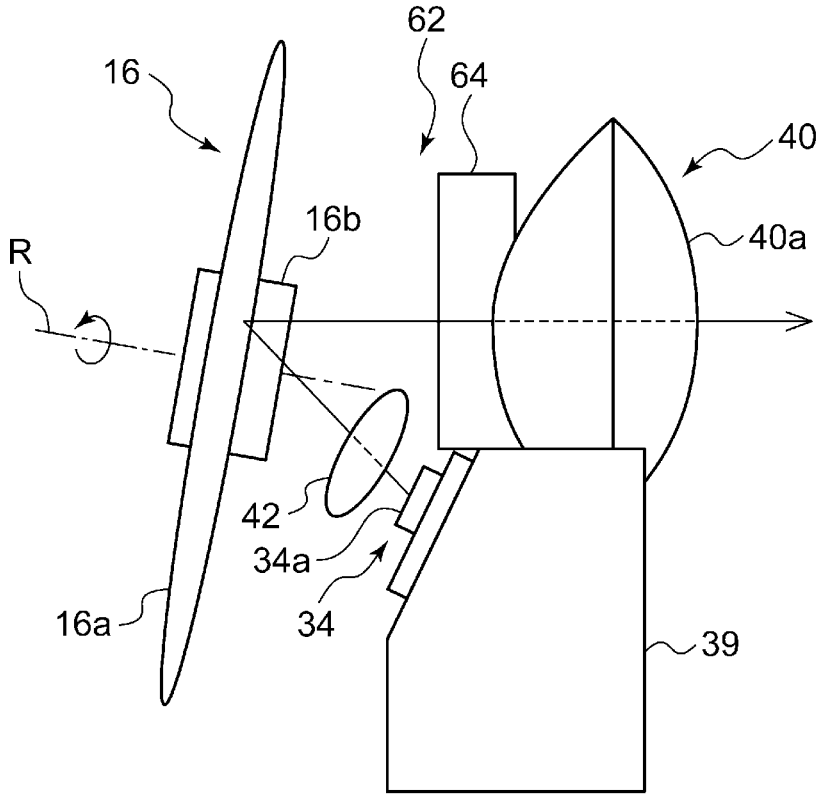
FIG. 10 is a side view schematically illustrating a general configuration of the vehicle headlamp according to the fourth embodiment.

FIG. 9 is a top view schematically illustrating a general configuration of a vehicle headlamp according to a fourth embodiment. FIG. 10 is a side view schematically illustrating a general configuration of the vehicle headlamp according to the fourth embodiment. Configurations similar to those in the foregoing embodiments are given identical reference characters, and descriptions thereof will be omitted as appropriate.

A vehicle headlamp 60 according to the fourth embodiment includes an optical unit 62. The optical unit 62 includes a projection lens 46 having two convex lens portions on an incident side and one convex lens portion on an exit side. A light-blocking portion 64 is provided on an incident surface 46*c* of the projection lens 46. The light-blocking portion 64 is disposed to prevent light emitted from the first light source 34 and reflected by the rotary reflector 16 from entering a second projecting portion 46*b* and to prevent light emitted from the second light source 36 and reflected by the rotary reflector 16 from entering a first projecting portion 46*a*.

The light-blocking portion 64 is a plate-like member and is disposed in a plane that includes a boundary 46*d* between the first projecting portion 46*a* and the second projecting portion 46*b* of the projection lens 46 and disposed behind the boundary 46*d*. This configuration can suppress, for example, a situation in which, although the second light source 36 is off, the light emitted from the first light source 34 passes through the second projecting portion 46*b* as stray light to produce glare. Alternatively, the above configuration can suppress a situation in which, although the first light source 34 is off, the light emitted from the second light source 36 passes through the first projecting portion 46*a* as stray light to produce glare.

(Variations)

Now, examples of the specification range of each configuration of the optical unit will be provided. An angle α (see FIG. 2) formed by the axis of rotation R of the rotary reflector 16 and the horizontal plane H is, for example, in a range of from 1° to 45°, preferably in a range of from 3° to 30°, or more preferably in a range of from 5° to 20°. The diameter of the rotary reflector 16 is, for example, in a range of from 30 mm to 100 mm, preferably in a range of from 40 mm to 80 mm, or more preferably in a range of from 50 mm to 70 mm.

The width (in the widthwise direction of the vehicle) of the projection lens is, for example, in a range of from 50 mm to 120 mm, preferably in a range of from 60 mm to 100 mm, or more preferably in a range of from 70 mm to 90 mm. The height (in the heightwise direction of the vehicle) of the projection lens is, for example, from 20 mm to 60 mm, preferably from 25 mm to 50 mm, or more preferably from 25 mm to 35 mm.

An angle β of incidence (see FIG. 2) at which light emitted from the light source is incident on the blades 16*a* of the rotary reflector is less than 45°, preferably no more than 30°, or more preferably no more than 20°. This configuration improves the efficiency with which the light flux reflected by the rotary reflector is incident on the projection lens.

Thus far, the present invention has been described with reference to the foregoing embodiments. The present invention, however, is not limited to the foregoing embodiments and also encompasses an embodiment obtained by combining and/or replacing configurations of the foregoing embodiments as appropriate. In addition, it is also possible to change the combinations and/or the processing orders in the embodiments or to make modifications such as various design changes to the embodiments on the basis of the knowledge of a person skilled in the art, and an embodiment obtained by making such modifications may also be encompassed by the scope of the present invention.

DESCRIPTION OF THE REFERENCE NUMERALS

10 vehicle headlamp, 12 optical unit, 14 light source, 14*a* light-emitting element, 15 element-mounting substrate, 16 rotary reflector, 16*a* blade, 16*b* rotary portion, 18 projection lens, 30 vehicle headlamp, 32 optical unit, 34 first light source, 34*a* light-emitting element, 36 second light source, 36*a* light-emitting element, 38 element-mounting substrate, 40 projection lens, 40*a* first projecting portion, 40*b* second projecting portion, 46*c* incident surface, 64 light-blocking portion

INDUSTRIAL APPLICABILITY

The present invention can find its use in vehicle lamps.

The invention claimed is:

1. An optical unit for use in a vehicle lamp, the optical unit comprising:

a light source; and a rotary reflector that rotates about an axis of rotation while reflecting light emitted from the light source, wherein the rotary reflector is disposed such that the axis of rotation of the rotary reflector intersects a horizontal plane and is not parallel to the horizontal plane.

2. The optical unit according to claim 1, further comprising:

a projection lens that projects the light emitted from the light source and reflected by the rotary reflector in a light-irradiation direction of the optical unit, wherein the light source is disposed between the rotary reflector and the projection lens in a front-back direction of a vehicle and below the axis of rotation of the rotary reflector.

3. The optical unit according to claim 2, wherein the light source includes a first light source including one or more first light-emitting elements and a second light source including one or more second light-emitting elements, and the rotary reflector reflects light emitted from the first light source off one region in a right or left side of the rotary reflector and reflects light emitted from the second light source off another region in the right or left side of the rotary reflector.

4. The optical unit according to claim 3, further comprising:

a substrate on which the first light source and the second light source are mounted.

5. The optical unit according to claim 3, wherein the projection lens includes a first projecting portion where the light emitted from the first light source and reflected by the rotary reflector enters and a second projecting portion where the light emitted from the second light source and reflected by the rotary reflector enters.

6. The optical unit according to claim 1, wherein the light source includes a first light source including one or more first light-emitting elements and a second light source including one or more second light-emitting elements, and the rotary reflector reflects light emitted from the first light source off one region in a right or left side of the rotary reflector and reflects light emitted from the second light source off another region in the right or left side of the rotary reflector.

7. The optical unit according to claim 5, wherein a light-blocking portion is provided on an incident surface of the projection lens, and the light-blocking portion is disposed to prevent the light emitted from the first light source and reflected by the rotary reflector from entering the second projecting portion and to prevent the light emitted from the second light source and reflected by the rotary reflector from entering the first projecting portion.

8. The optical unit according to claim 5, wherein the first projecting portion has a posterior focal length L1 greater than a posterior focal length L2 of the second projecting portion, and the axis of rotation of the rotary reflector is inclined toward the first projecting portion relative to the front-back direction of the vehicle.

9. The optical unit according to claim 1, wherein the rotary reflector includes a rotary portion, and a plurality of blades that are provided around the rotary portion and that function as a reflective surface, and the reflective surface is provided such that light from the light source reflected by the rotating reflective surface forms a light-distribution pattern.

10. An optical unit for use in a vehicle lamp, the optical unit comprising:

a light source;

a rotary reflector that rotates about an axis of rotation while reflecting light emitted from the light source, wherein the rotary reflector is disposed such that the axis of rotation of the rotary reflector intersects a horizontal plane;

a projection lens that projects the light emitted from the light source and reflected by the rotary reflector in a light-irradiation direction of the optical unit, wherein the light source is disposed between the rotary reflector and the projection lens in a front-back direction of a vehicle and below the axis of rotation of the rotary reflector, the light source includes a first light source including one or more first light-emitting elements and a second light source including one or more second light-emitting elements, and the rotary reflector reflects light emitted from the first light source off one region in a right or left side of the rotary reflector and reflects light emitted from the second light source off another region in the right or left side of the rotary reflector, the projection lens includes a first projecting portion where the light emitted from the first light source and reflected by the rotary reflector enters and a second projecting portion where the light emitted from the second light source and reflected by the rotary reflector enters; and a light-blocking portion is provided on an incident surface of the projection lens, and the light-blocking portion is disposed to prevent the light emitted from the first light source and reflected by the rotary reflector from entering the second projecting portion and to prevent the light emitted from the second light source and reflected by the rotary reflector from entering the first projecting portion.

* * * * *